US005544825A

United States Patent [19]

Stehr

[11] Patent Number: 5,544,825

[45] Date of Patent: Aug. 13, 1996

[54] AGITATOR MILL

[75] Inventor: Norbert Stehr, Grünstadt, Germany

[73] Assignee: EVV-Vermögensverwaltungs-GmbH, Weisloch, Germany

[21] Appl. No.: 519,020

[22] Filed: Aug. 24, 1995

[30] Foreign Application Priority Data

Sep. 9, 1994 [DE] Germany ..... 44 32 198.8

[51] Int. Cl.[6] ..... B02C 17/16

[52] U.S. Cl. ..... 241/171; 241/172; 241/174

[58] Field of Search ..... 241/171, 172, 241/46.17, 179, 174

[56] References Cited

U.S. PATENT DOCUMENTS

| | | | |
|---|---|---|---|
| 2,595,117 | 4/1952 | Ahlmann | 241/19 |
| 4,065,060 | 12/1977 | Booz | 241/16 |
| 4,496,106 | 1/1985 | Gross | 241/46.17 |
| 4,754,934 | 7/1988 | Ikebuchi et al. | 241/69 |
| 5,199,656 | 4/1993 | Szegvari et al. | 241/171 |

*Primary Examiner*—John Husar
*Attorney, Agent, or Firm*—Browdy and Neimark

[57] ABSTRACT

An agitator mill comprises a grinding receptacle, in which a high-speed agitator is disposed. An auxiliary-grinding-body outlet discharges from an end of the grinding receptacle, a grinding-stock and auxiliary-grinding-body return line leading from this outlet to the other end of the grinding receptacle. Directly adjoining the auxiliary-grinding-body outlet, a grinding-stock supply line opens into the line, which ensures the auxiliary grinding bodies to circulate reliably.

11 Claims, 5 Drawing Sheets

AGITATOR MILL

BACKGROUND OF THE INVENTION

1. Field of the Invention

The invention relates to an agitator mill comprising a grinding receptacle defining a grinding chamber, a high-speed agitator disposed in the grinding receptacle, auxiliary grinding bodies at least partially filling the grinding chamber, a grinding-stock/auxiliary-grinding-body inlet opening into the grinding chamber and disposed at one end of the grinding receptacle, an auxiliary-grinding-body retaining device disposed at the other end of the grinding receptacle for grinding stock to be discharged, an auxiliary-grinding-body outlet adjoining the retaining device and disposed upstream of the latter towards the other end of the grinding receptacle, an auxiliary-grinding-body return line leading from the auxiliary-grinding-body outlet to the grinding-stock/auxiliary-grinding-body inlet, a grinding-stock supply line to be passed through in a direction of flow of the grinding stock, and a junction, which—referred to the direction of flow—is disposed upstream of the grinding-stock/auxiliary-grinding-body inlet, and where the grinding-stock supply line and the auxiliary-grinding-body return line are joined to form a grinding-stock supply and auxiliary-grinding-body return line.

2. Background Art

An agitator mill of the generic type is known from U.S. Pat. No. 4,496,106, in which the auxiliary-grinding-body return line opens into the grinding-stock supply line by an angle of 90° directly before the grinding-stock/auxiliary-grinding-body inlet. As a result of the centrifugal effect produced by the agitator unit, the auxiliary grinding bodies and grinding stock not sufficiently milled are to be catapulted off through the auxiliary-grinding-body outlet and returned through the grinding-body return line. By the grinding-body return line opening into the grinding-stock supply line, a suction is to be generated which still supports the centrifugal effect. Further, excellent preliminary mixing of the grinding stock and the auxiliary grinding bodies is to result in the grinding-stock supply line. Experience has shown that any reliable circulation of the auxiliary grinding bodies cannot be ensured by this design of the known agitator mill. The auxiliary grinding bodies get stuck in the auxiliary-grinding-body return line, where they stay. Although, owing to their basic concept, agitator mills of this type have considerable advantages where a high throughput of grinding stock is required that is marked by a considerable transport of auxiliary grinding bodies in the grinding chamber to the separator device, this type of agitator mills has not been successful in practice, because the circulation of the auxiliary grinding bodies does not work.

U.S. Pat. No. 2,595,117 discloses a dry milling ball mill. In this ball mill, the milled grinding stock and the grinding bodies are removed in common through a discharge line and placed into a vertical air duct serving as an air separator. Air is blown from below through this vertical air duct, transporting all the smaller particles into a separator. The grinding balls and the coarse fraction of the grinding stock will fall through the duct against the air stream and are returned to the mill via a conveyor worm. In the separator, sufficiently fine material is once again separated from the grinding stock not sufficiently milled. The latter is likewise fed to the worm via a line.

SUMMARY OF THE INVENTION

It is the object of the invention to embody an agitator mill of the generic type such that a reliable circulation of the auxiliary grinding bodies is achieved.

According to the invention this object is achieved by the junction being directly adjacent to the auxiliary-grinding-body outlet. The fact that the auxiliary grinding bodies are taken along by the to-be-supplied grinding stock directly behind the auxiliary-grinding-body outlet causes a hydraulic transport of the auxiliary grinding bodies by means of the grinding stock that serves as a transporting medium. As a result, the auxiliary grinding bodies are reliably circulated. Blocking of the agitator mill by too high a concentration of auxiliary grinding bodies before the separator device is precluded. The mill can be operated reliably at high throughputs, there being no risk of such a block-up. Since there is a uniform distribution of auxiliary grinding bodies in the grinding chamber owing to the auxiliary-grinding-body circulation, the reproducibility of grinding stock fineness is very high with varying throughputs which may be very high. Surprisingly it has been found that short-cut flowing of the grinding stock will not occur.

It has been found that the use of a disk agitator will give better grinding results than a cylinder agitator, the grinding stock having an increased dwell time in the agitator mill with disk agitators than it has with cylinder agitators. In particular when high throughputs are envisaged, a sufficient dwell time can be achieved with disk agitators.

Further features, details and advantages of the invention will become apparent from the description of two exemplary embodiments, taken in conjunction with the drawing.

DESCRIPTION OF THE PREFERRED EMBODIMENTS

Figure 1:
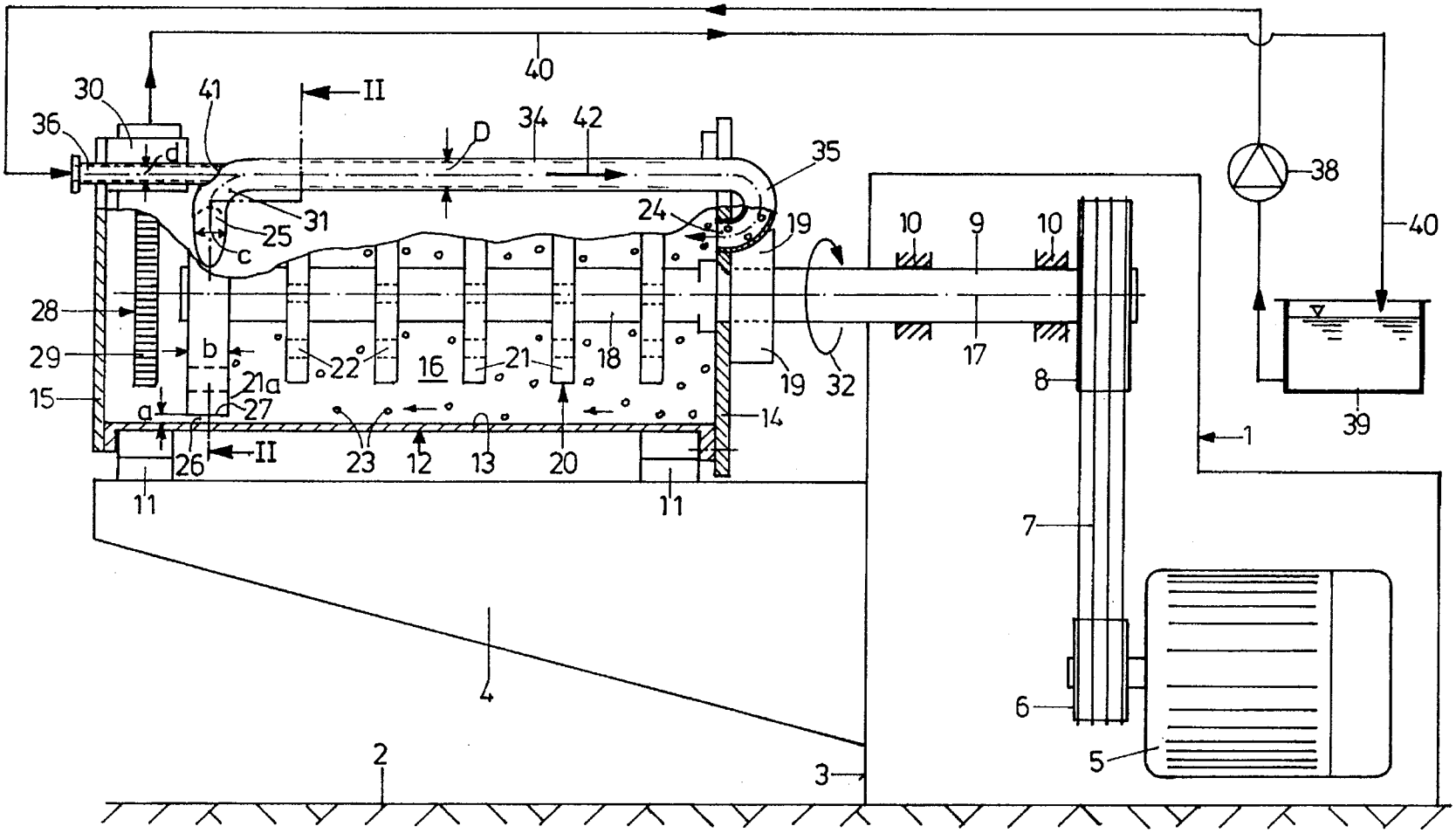
FIG. 1 is a diagrammatic illustration of a vertical section of a horizontal agitator mill.
Figure 2:
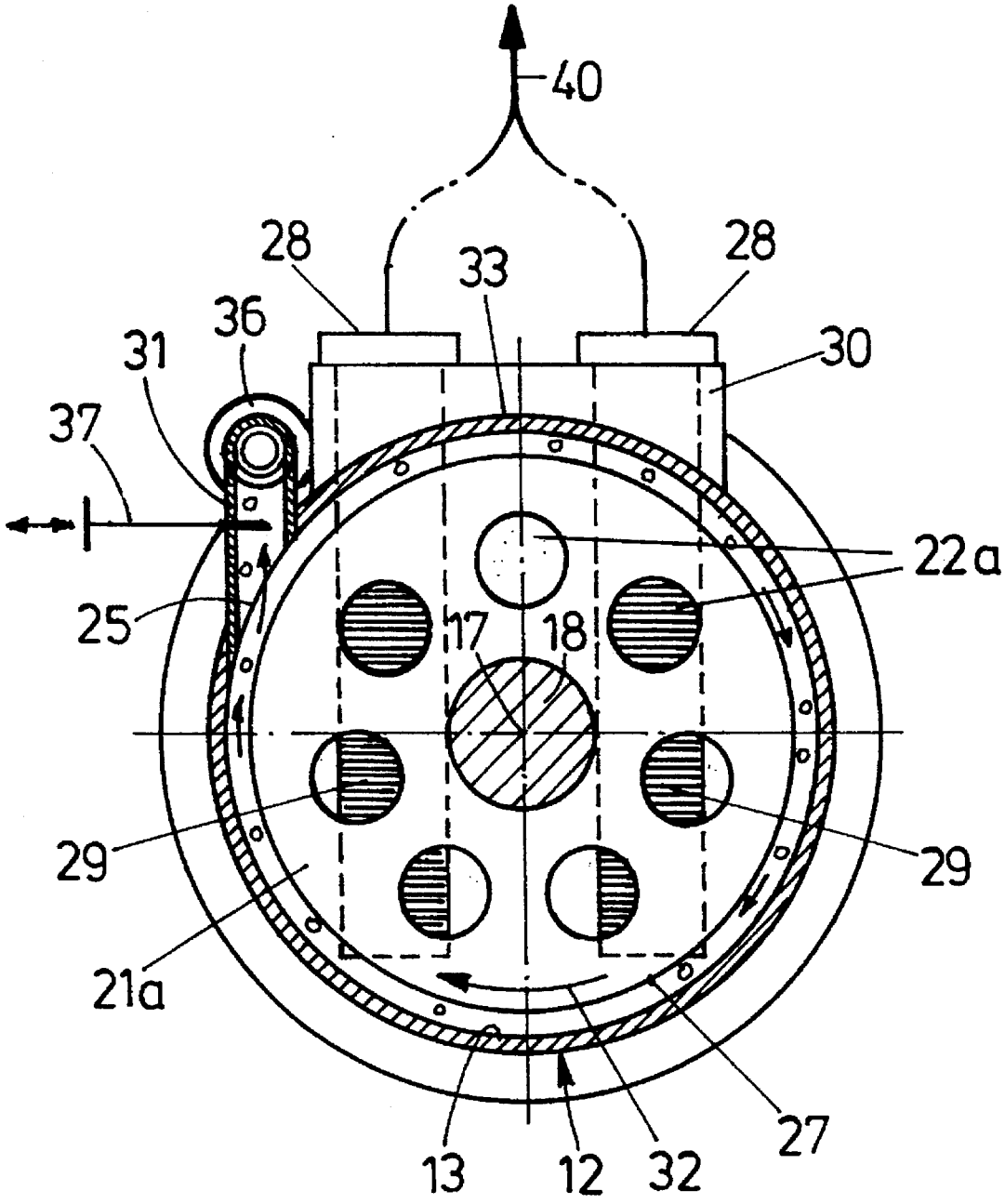
FIG. 2 is a cross-section of FIG. 1 on the section line II—II.

FIGS. 1 and 2 show a so-called horizontal agitator mill conventionally comprising a stand 1, which is supported on the ground 2. The face 3 of the stand 1 is provided with a support arm 4.

The stand houses a drive motor 5 speed-variable, if required, which is provided with a V-belt pulley 6, by means of which a drive shaft 9 can be driven for rotation by way of a V-belt 7 and another V-belt pulley 8. The drive shaft 9 is rotatably run on several bearings 10 in the stand 1.

A substantially cylindrical grinding receptacle 12 is supported on the support arm 4 in corresponding retainers 11. The grinding receptacle 12 has a cylindrical wall 13, its end facing the stand 1 being closed by a lid 14 and the opposite end by a bottom 15. It encloses a grinding chamber 16.

An agitator shaft 18 passing through the lid 14 is disposed in the grinding chamber 16 concentrically of the common central longitudinal axis 17 of the grinding receptacle 12 and the drive shaft 9. The grinding chamber 16 is sealed by seals 19 between the lid 14 and the shaft 18. The shaft 18 is cantilevered, i.e. it is not run on bearings in the vicinity of the bottom 15. Over its entire length within the grinding chamber 16, it is provided with agitator elements 20, which are agitator disks 21, 21*a* in the present case. The agitator disks 21, 21*a* may additionally be provided with openings 22 and 22*a*—as seen in FIG. 2. The grinding chamber 16 is filled with auxiliary grinding bodies 23 at least to a substantial extent.

A grinding-stock/auxiliary-grinding-body inlet 24 formed in the lid 14 opens into the grinding chamber 16 in the vicinity of the stand 1. At the other end of the grinding chamber 16, i.e. adjoining the bottom 15, an auxiliary-grinding-body outlet 25 discharges from the grinding chamber 16; the auxiliary-grinding-body outlet 25 is disposed on a radial plane common to it and to the last agitator element 20 mounted on the agitator shaft 18, i.e. the last agitator disk 21*a*. As seen in FIG. 1, the last agitator disk 21*a* has a greater diameter than the other agitator disks 21, leaving only a comparatively small annular space 26 towards the wall 13 of the grinding receptacle 12. Radially to the central longitudinal axis 17, the width a of this annular space 26 amounts to 10 to 50 mm.

The width b of the agitator disk 21*a* in the direction of the axis 17 like-wise exceeds the corresponding width of the other agitator disks 21, as can be seen from FIG. 1. The width b is at least equal to the width c of the auxiliary-grinding-body outlet 25 in the direction of the central longitudinal axis 17 so that the agitator disk 21*a*, by its cylindrical circumference 27, entirely covers the auxiliary-grinding-body outlet 25 in the direction of the axis 17. The agitator disk 21*a* has a diameter and a width in the direction of the axis 17 exceeding those of the agitator disks 21. This agitator disk 21*a* disposed before the auxiliary-grinding-body outlet 25 has the function of a cylinder agitator in this defined area, whereas the grinding chamber 16 houses a disk agitator.

Between the outlet 25 and the associated agitator disk 21*a* on the one hand and the bottom 15 on the other, auxiliary-grinding-body retaining devices 28 are arranged in the form of so-called filter cartridges 29, which are held in corresponding connectors 30 provided in the wall 13 of the grinding receptacle 12 and can be pulled outwards out of these and out of the grinding chamber 16. Such filter cartridges 29 are known to be used in agitator mills for instance from U.S. Pat. No. 3,780,957.

The auxiliary-grinding-body outlet 25 is followed by an auxiliary-grinding-body return pipe socket 31, which is directed upwards substantially tangentially on a radial plane referred to the axis 17. The auxiliary-grinding-body return pipe socket 31 is arranged such that the direction of rotation 32 of the circumference 27 of the agitator disk 21*a* runs into it tangentially. This auxiliary-grinding-body return pipe socket 31 is a quadrant pipe, which passes into a straight grinding-stock supply and auxiliary-grinding-body return line 34 extending parallel to the axis 17 and disposed contiguous to the upper side 33 and directly beside the wall 13 of the grinding receptacle. This line 34 is connected with the grinding-stock/auxiliary-grinding-body inlet 24 by way of a 180° elbow 35. In alignment with the line 34, a grinding-stock supply line 36 opens into the pipe socket 31, having an inter/or diameter d that is smaller than the interior diameter D of the grinding-stock supply and auxiliary-grinding-body return line 34 and the pipe socket 31. This helps achieve a flow rate in the grinding-stock supply line 36 which exceeds the flow rate in the line 34 and the pipe socket 31. This increased flow rate causes the auxiliary grinding bodies to be well distributed within the grinding stock, which results in a considerable hydraulic transport of the auxiliary grinding bodies 23 and prevents the auxiliary grinding bodies from escaping back into the pipe socket 31. Of course, the grinding-stock supply line 36 can be integrally formed on or, respectively, made in one piece with, the line 34. A shut-off device 37 in the form of a slide, valve or adjusting throttle, which may serve as a start-up aid, is disposed in the auxiliary-grinding-body return pipe socket 31.

From a reservoir 39, grinding stock is supplied to the grinding-stock supply line 36 in the usual way by means of a pump 38 and passes through the grinding-stock supply and auxiliary-grinding-body return line 34 and the 180° elbow 35 into an end of the grinding receptacle 12. In the grinding chamber 16, the high-speed agitator elements 20 subject the grinding stock and the auxiliary grinding bodies 23 to an intense dispersing, milling and shearing process, this mix flowing through the grinding chamber 16 in the direction towards the outlet 25 and the retaining devices 28. The grinding stock is discharged through the retaining devices 28 and, if necessary, returned to the reservoir 39 via a discharge line 40. In front of the retaining devices 28, the auxiliary grinding bodies 23 are catapulted off into the pipe socket 31 by means of the agitator disk 21*a* disposed before the outlet 25. They flow through the very short and bent pipe socket 31 to the junction 41 where the supply line 36 opens into the grinding-stock supply and auxiliary-grinding-body return line 34. The stream of grinding stock supplied via the grinding-stock supply line 36 tindertakes the return of the auxiliary grinding bodies to the inlet 24, i.e. back into the grinding chamber 16. As a result of the supply line 36, the pipe socket 31 and the line 34 being joined as specified at the junction 41 and as a result of the very short design of the pipe socket 31, any short-cut flow of grinding stock from the supply line 36 and the pipe socket 31 into the grinding chamber 16 and from there into the separators 28 is precluded. Among other things this is due to the fact that, owing to the specified design, the flow resistance of the flow of grinding stock and auxiliary grinding bodies 23 in the direction of flow 42 through the line 34 would be inferior to the flow resistance in the case of an acute deflection of the grinding stock from the supply line 36 into the pipe socket 31 against the pressure of the auxiliary grinding bodies 23. The pressure of the auxiliary grinding bodies 23 in the pipe socket 31 is very high, since the auxiliary grinding bodies are forced at a high speed into the pipe socket 31 by the circumference 27 of the agitator disk 21*a*, there being almost no clearance space between the circumference 27 and the wall 13 of the grinding receptacle 12. The grinding stock itself flows through openings 22*a* located within the circumference 27 of the agitator disk 21*a*, from where is reaches the retaining devices 28.

Figure 5:
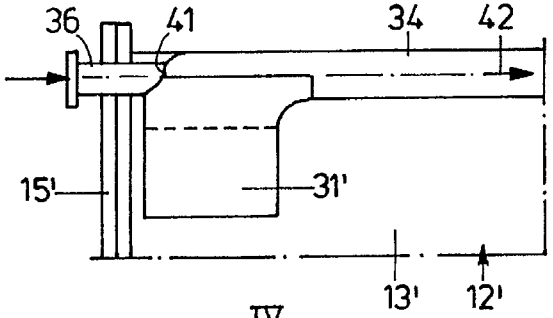
FIG. 5 is a partial view from FIG. 3 according to the arrow V of FIG. 4.
Figure 3:
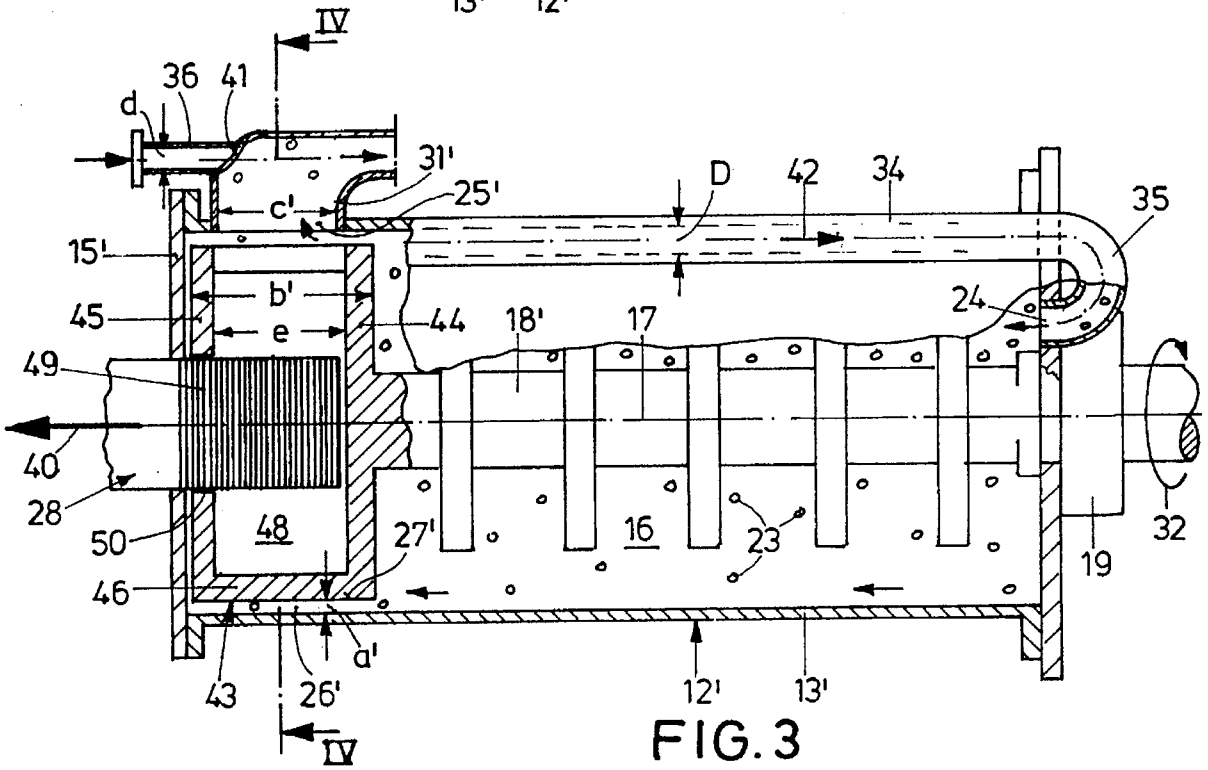
FIG. 3 is a diagrammatic illustration of a vertical section of a second embodiment of a horizontal agitator mill.
Figure 4:
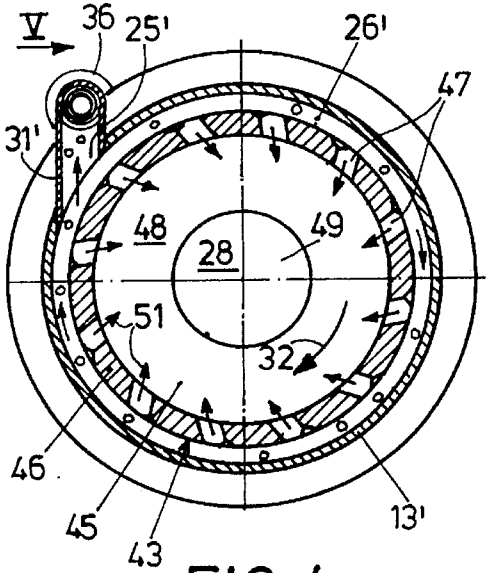
FIG. 4 is a cross-section of FIG. 3 on the section line IV—IV of FIG. 3.

In as much as identical parts are used in the embodiment according to FIGS. 3 to 5 and in the embodiment according to FIGS. 1 and 2, they have the same reference numerals. If there are parts of identical function, which differ in construction, the same reference numerals are used as in FIGS. 1 and 2, however provided with a prime. In this case there is no need of renewed description.

The stand supporting the grinding receptacle 12' and comprising a drive for the agitator shaft 18' is not illustrated in FIG. 3. An auxiliary-grinding-body outlet 25' is provided in the cylindrical wall 13' in the proximity of the bottom 15'. The free end of the agitator shaft 18' is provided with a cage-type section 43, which comprises a closed disk 44 attached to the agitator shaft 18'. Parallel to this closed disk 44, there is an annular disk 45, which is also disposed concentrically of the central longitudinal axis 17. The annular disk 45 is directly contiguous to the bottom 15'. The disk 44 and the annular disk 45 are joined by a cylindrical wall 46 in the vicinity of the circumferences. This cylindrical wall 46 is provided with grinding-stock inlet passages 47, which, referred to the direction of rotation 32 of the agitator shaft 18', are directed forward from the outside inwards, as seen in FIG. 4. A filter cylinder 49 passing through the bottom 15' and the annular disk 45 projects into the interior chamber 48 of the cage-type section 43 as an auxiliary-grinding-body retaining device 28. The inner edge 50 of the annular disk 45 is approximately free from play towards the filter cylinder 49 so that no auxiliary grinding bodies 23 can enter the interior chamber 48.

The cage-type section 43 has a width b' in the direction of the axis 17 which exceeds the width c' of the outlet 25' in the direction of the axis 17. This width c' corresponds approximately to the extension e of the interior chamber 48 in the direction of the axis 17. The annular space 26' between the substantially cylindrical circumference 27' of the cage-type section 43 has a width a', to which apply the details of the embodiment according to FIGS. 1 and 2. The cage-type section 43 may also be considered as an agitator disk of an especially thick, hollow design in the direction of the axis 17.

The auxiliary-grinding-body outlet 25', elongate in the direction of the axis 17, is followed by an auxiliary-grinding-body return pipe socket 31', which is shaped almost as a box in the lateral view according to FIGS. 3 and 5, and the actual position of which relative to the grinding receptacle 12' can be seen from FIGS. 4 and 5. In FIG. 3 it is illustrated to be displaced radially outwards for an illustration of a longitudinal sectional view to be possible.

The function of the agitator mill according to FIGS. 3 to 5 differs from the embodiment according to FIGS. 1 and 2 only in that at the end of the grinding chamber 16, the grinding stock and the auxiliary grinding bodies 23 enter the annular space 26', from where the grinding stock is piloted through the grinding-stock inlet passages 47 into the interior chamber 48 of the cage-type section 43 according to the arrows of flow direction 51. The auxiliary grinding bodies 23 are forced through the outlet 25' into the very short pipe socket 31' and are taken along by the grinding stock at the junction 41 of the grinding-stock supply line 36 and are then transported hydraulically through the line 34 to the grinding-stock/auxiliary-grinding-body inlet 24. The grinding stock is discharged through the retaining device 28 and, if necessary, is returned to the reservoir 39 via a discharge line 40 (roughly outlined).

Figure 6:
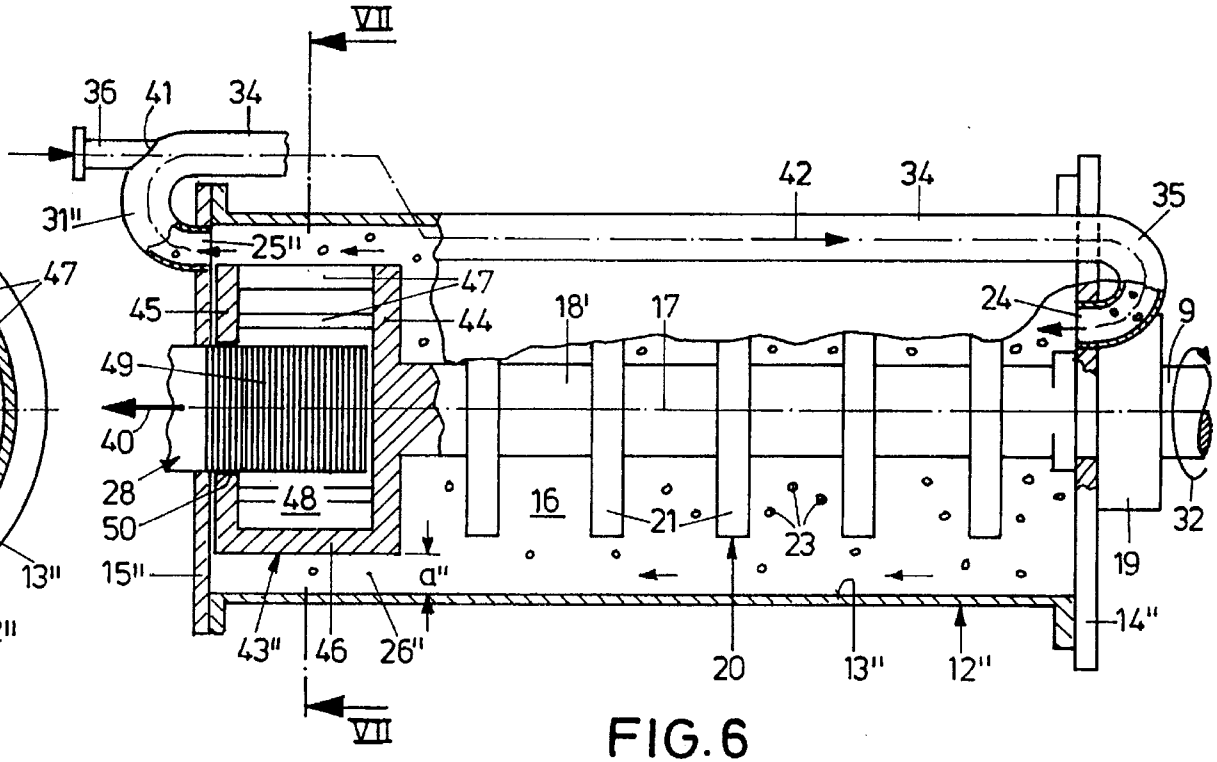
FIG. 6 is a diagrammatic illustration of a vertical section of a third embodiment of a horizontal agitator mill.
Figure 7:
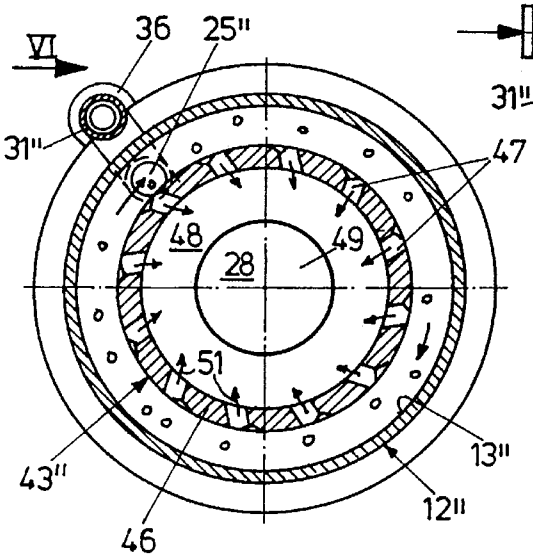
FIG. 7 is a cross-section of FIG. 6 on the section line VII—VII.

FIGS. 6 and 7 illustrate another embodiment of a horizontal agitator mill, which is largely identical with the horizontal agitator mill according to FIGS. 3 and 5 in terms of construction. Therefore, identical parts have identical reference numerals and parts of identical function but differing in construction have the same reference numerals, however provided with a double prime. There is no need of renewed description.

The auxiliary-grinding-body outlet 25" is situated in the upper portion of the bottom 15" of the grinding receptacle 12". Consequently, the annular space 26" between the cage-type section 43" and the cylindrical wall 13" of the grinding receptacle 12" exceeds that of the agitator mill according to FIGS. 3 to 5, i.e. the width a" of the annular space 26" radially to the axis 17 amounts to 25 to 100 mm. The auxiliary-grinding-body outlet 25" is followed by an auxiliary-grinding-body return pipe socket 31" in the form of a 180° elbow, which passes into the line 34 at the junction 41. FIG. 6, upper left, shows this pipe socket 31" to be displaced in relation to the line 34 for an illustration of the pipe socket 31" in this figure to be possible.

In this agitator mill, the grinding stock and the auxiliary grinding bodies 23 flow through the grinding chamber 16 and enter the comparatively wide annular space 26". This is where the grinding sotck passes through the passages 47 into the interior chamber 48 of the cage-type section 43" and is discharged via the filter cylinder 49. The auxiliary grinding bodies 23 are removed from the grinding chamber 16 via the outlet 25" and fed to the hydraulic return transport via the pipe socket 31". By way of the reservoir 39, the grinding stock can be recirculated in the same way as with the embodiments described above.

Figure 8:
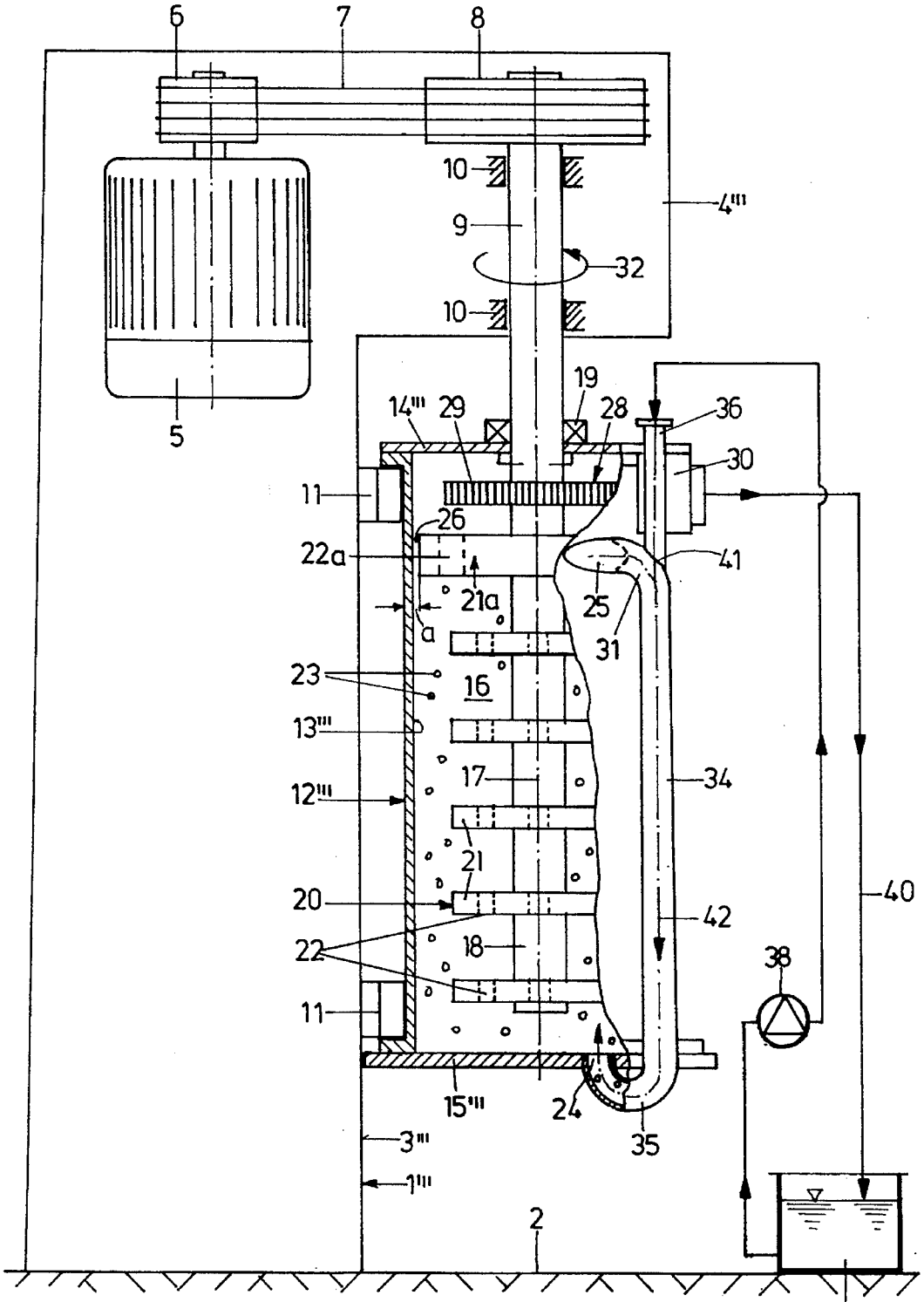
FIG. 8 is a diagrammatic illustration of a vertical section of an upright agitator mill.

FIG. 8 illustrates a so-called upright agitator mill, which is largely identical with the horizontal agitator mill according to FIGS. 1 and 2 in terms of construction. Identical parts are again provided with identical reference numerals and parts of identical function, but slightly differing in construction, have the same reference numerals, however provided with a triple prime. There is no need of renewed description.

The upright agitator mill according to FIG. 8 differs from the agitator mill according to FIG. 1 in that the grinding-stock/auxiliary-grinding-body inlet 24 is located in the downside bottom 15''' of the substantially vertical grinding receptacle 12'''. The auxiliary-grinding-body outlet 25 is disposed in the vicinity of the upside lid 14'''. This also applies to the auxiliary-grinding-body retaining device 28. In this case, the grinding-stock supply line 36 is guided from an area above the grinding receptacle 12''' downwards to the grinding-stock supply and auxiliary-grinding-body return line 34. In this case, the agitator disk **21*a* adjoining the lid 14''' is located before the auxiliary-grinding-body outlet 25 radially to the axis 17. The function is the same as in the embodiment according to FIGS. 1 and 2, the grinding stock and the auxiliary grinding bodies however flowing through the grinding chamber 16 in an upward direction from the bottom 15''' towards the lid 14'''**.

What is claimed is:

1. An agitator mill comprising a grinding receptacle (12, 12', 12", 12''') having a wall (13, 13') and a first end and a second end, and defining a grinding chamber (16), a high-speed agitator disposed in the grinding receptacle (12, 12', 12", 12''') and having a central longitudinal axis (17), auxiliary grinding bodies at least partially filling the grinding chamber (16), a grinding-stock/auxiliary-grinding-body inlet (24) opening into the grinding chamber (16) and disposed at the first end of the grinding receptacle (12, 12', 12", 12'''), an auxiliary-grinding-body retaining device (28) disposed at the second end of the grinding receptacle (12, 12', 12", 12''') for grinding stock to be discharged, an auxiliary-grinding-body outlet (25, 25', 25") adjoining the retaining device (28) and disposed upstream of the retaining device (28) towards the second end of the grinding receptacle (12, 12', 12", 12'"), an auxiliary-grinding-body return line leading from the auxiliary-grinding-body outlet (25, 25', 25") to the grinding-stock/auxiliary-grinding-body inlet (24), a grinding-stock supply line (36) to be passed through in a direction of flow (42) of a grinding stock, and a junction (41), which—referred to the direction of flow (42)—is disposed upstream of the grinding-stock/auxiliary-grinding-body inlet (24), and where the grinding-stock supply line (36) and the auxiliary-grinding-body return line are joined to form a grinding-stock supply and auxiliary-grinding-body return line (34), wherein the junction (41) is directly adjacent to the auxiliary-grinding-body outlet (25, 25', 25").

2. An agitator mill according to claim 1, wherein at the junction (41), the grinding-stock supply line (36) and the grinding-stock supply and auxiliary-grinding-body return line (34) do not exhibit any substantial change of direction in the direction of flow (42).

3. An agitator mill according to claim 1, wherein a pipe socket (31, 31', 31") leads from the auxiliary-grinding-body outlet (25, 25', 25") to the junction (41), which pipe socket (31, 31', 31") is an elbow passing into the grinding-stock supply and auxiliary-grinding-body return line (34) approximately in the direction of flow (42).

4. An agitator mill according to claim 1, wherein an agitator element (20) is assigned to the auxiliary-grinding-body outlet (25, 25', 25"), the agitator element (20) covering the auxiliary-grinding-body outlet (25, 25', 25") in the direction of the central longitudinal axis (17).

5. An agitator mill according to claim 4, wherein the agitator element (20) covering the auxiliary-grinding-body outlet (25) is an agitator disk (21*a*).

6. An agitator mill according to claim 4, wherein the agitator element (20) covering the auxiliary-grinding-body outlet (25', 25") is a cage-type section (43, 43").

7. An agitator mill according to claim 6, wherein the auxiliary-grinding-body retaining device (28) is a filter cylinder (49) projecting into the cage-type section (43, 43").

8. An agitator mill according to claim 1, wherein an annular space (26, 26') of inferior width (a, a') is formed between the agitator element covering the auxiliary-grinding-body outlet (25, 25') and the wall (13, 13') of the grinding receptacle (12, 12', 12'").

9. An agitator mill according to claim 1, wherein the grinding-stock supply and auxiliary-grinding-body return line (34) is disposed in the proximity of the grinding receptacle (12, 12', 12'").

10. An agitator mill according to claim 1, wherein the auxiliary-grinding-body retaining device (28) is a filter cartridge (29) disposed between the agitator disk (21*a*) and an end wall (15) of the grinding receptacle (12, 12'").

11. An agitator mill according to claim 1, wherein the agitator is a disk agitator.

* * * * *